United States Patent [19]

Di Maio

[11] Patent Number: 4,784,207

[45] Date of Patent: Nov. 15, 1988

[54] APPARATUS FOR VACUUM MELTING AND CASTING

[75] Inventor: Eliseo Di Maio, Milan, Italy

[73] Assignee: Mario Di Maio S.p.A., Milan, Italy

[21] Appl. No.: 110,555

[22] Filed: Oct. 16, 1987

Related U.S. Application Data

[63] Continuation of Ser. No. 822,771, Jan. 24, 1986, abandoned.

[30] Foreign Application Priority Data

Jan. 31, 1985 [IT] Italy ..... 20657/85[U]
Jan. 8, 1986 [IT] Italy ..... 20416/86[U]

[51] Int. Cl.[4] ..... B22D 18/06; B22D 27/15

[52] U.S. Cl. ..... 164/255; 164/256; 164/258

[58] Field of Search ..... 164/256, 258, 255, 61, 164/65

[56] References Cited

U.S. PATENT DOCUMENTS

| | | | |
|---|---|---|---|
| 1,070,500 | 8/1913 | Mackenzie | 164/258 |
| 2,825,945 | 3/1958 | Ulrech et al. | 164/258 |
| 2,882,570 | 4/1959 | Brennan | 164/256 X |
| 3,536,125 | 10/1970 | Blasko et al. | 164/258 |
| 3,705,615 | 12/1972 | Watts | 164/256 X |
| 4,538,671 | 9/1985 | Waterstrat | 164/258 X |

FOREIGN PATENT DOCUMENTS

| | | | |
|---|---|---|---|
| 3220744 | 12/1983 | Fed. Rep. of Germany | 164/259 |
| WO82/01677 | 5/1982 | PCT Int'l Appl. . | |
| 808834 | 2/1959 | United Kingdom . | |
| 831887 | 4/1960 | United Kingdom . | |
| 1370330 | 10/1974 | United Kingdom . | |

*Primary Examiner*—Nicholas P. Godici
*Assistant Examiner*—J. Reed Batten, Jr.
*Attorney, Agent, or Firm*—Ladas & Parry

[57] ABSTRACT

An apparatus for lost-wax castings wherein metal is melted in a vacuum vessel, and wherein there are provided vacuum pumps for producing a higher degree of vacuum around the mold during the casting of the molten metal.

5 Claims, 3 Drawing Sheets

APPARATUS FOR VACUUM MELTING AND CASTING

This is a continuation of co-pending application Ser. No. 822,771, filed on Jan. 24, 1986, and now abandoned.

The present invention provides for an apparatus allowing to effect castings by the so-called "lost-wax" method, whereby the whole operating cycle is accomplished under vacuum. The apparatus according to the invention is more practical and easier to use compared to the known ones, allows to improve the quality of castings and, thanks to the special arrangement of its components, to automate all the cycle phases, programming them so as to allow the repetitiveness thereof.

The employ of vacuum in order to improve the quality of the lost-wax castings is long known in the goldsmith's craft.

To this end, the plaster mold, after having been prepared and baked beforehand, is placed in a basket located in turn in a watertight vessel wherein, while the melted metal is cast, a certain degree of vacuum is created: this allows to eliminate, by sucking them through the plaster pores, all the air residues inside the mold, to obtain a first quality casting. According to the prior art, therefore, the casting of metal takes place at room temperature, and vacuum is applied about the plaster mold only at the moment of tapping, using known apparatuses linked to a chamber wherein the basket that contains the mold is inserted, provided of course with suitable gaskets connected with the mouth.

With a view to further improving the quality of the castings obtained by this method, simplifying the different stages of the process, the present invention provides for an apparatus wherein all the cycle phases, inclusive of casting, are accomplished under vacuum, and wherein it is possible to programme the apparatus so as to obtain a completely automatic working, the operator attending only to feeding the necessary amount of metal and to setting the mold in place.

In particular, the apparatus according to the invention provides for means allowing to insert the plaster mold without it being necessary to open the apparatus, there being provided devices capable of exactly positioning the basket inside the vacuum chamber.

The present invention will now be described in detail, with special reference to the accompanying drawings, wherein:

FIG. 4 shows a particular of FIG. 3.

Figure 1:
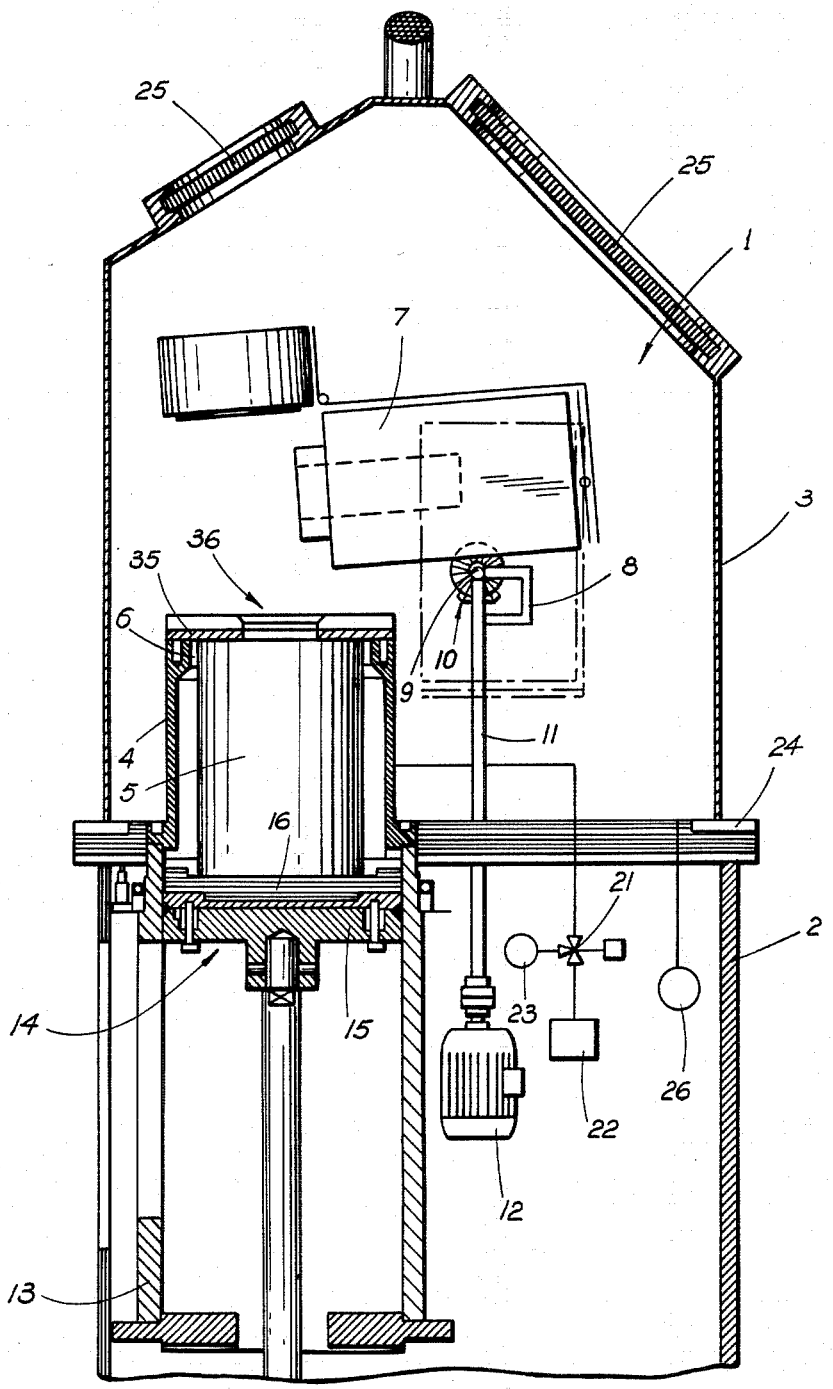
FIG. 1 shows a partial, schematic section of an apparatus according to the invention.

The apparatus according to the invention consists essentially of a chamber, indicated as a whole by No. 1, limited by a bed 2 and a bell 3, on the inside of which there is a second substantially cylindrical chamber 4; in this chamber is inserted a basket 5 that contains the mold, said basket having a proper gasket (not shown) connected with its upper edge.

Above chamber 4 there is a melting furnace 7, mounted on a support 8 by a pivoting pin 9.

The pin 9 is pivoted, by means of a gear combination 10 and a shaft 11, by a preferably electric motor 12 located beneath and outside chamber 1.

The support 8 of the furnace and the connected devices are not fixed, but may be adjusted by known ways, so that when the furnace is rotated by motor 12 it is possible to drive the melted metal exactly towards the central area of the mold.

Moreover the furnace 7, that may be of the electric heating or of the high frequency heating kind, is preferably provided with a cover or the like, that is automatically lifted by electromagnetic or pneumatic devices of known kind when the furnace is inclined to cast the melted metal.

Inside the bed 2 there is a cylinder 13 within which slides a piston 14, actuated by hydraulic or pneumatic means of known kind not shown in the drawing.

The bottom of chamber 4 is open and communicates directly with the inside of cylinder 13. Chamber 4 is defined above by a wall 35 in the central part of which there is a hole 36 for the passage of the melted metal. The lower wall of chamber 4, on the contrary, consists essentially of piston 14. This is made of a lower and an upper part, indicated by No. 15 and 16 respectively, that tend to be kept spaced apart by a plurality of helical springs 17, housed in seats made in the lower part 15.

Connected with the facing surfaces, said parts 15 and 16 have a dull edge, so as to define an annular seat wherein a gasket 18 of elastic material, such as rubber or the like, is inserted.

Figure 2:
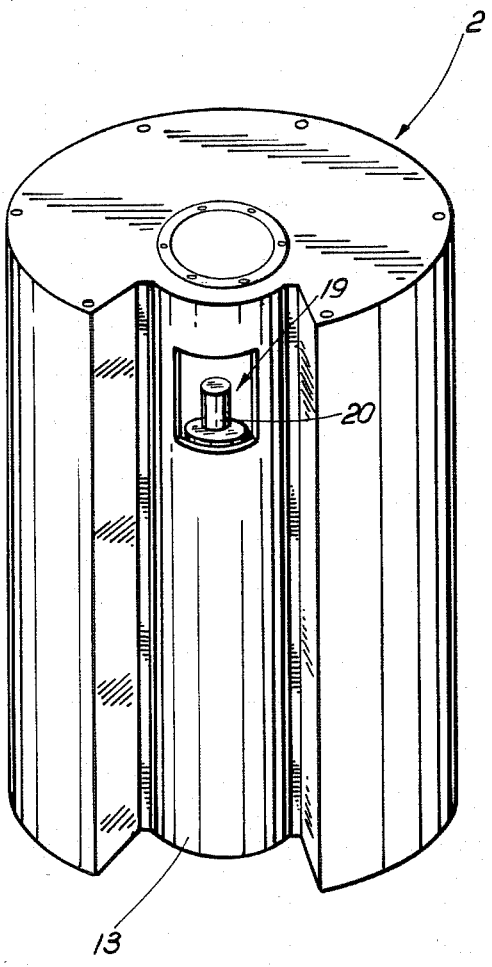
FIG. 2 shows schematically the bed of an apparatus according to the invention.
Figure 3:
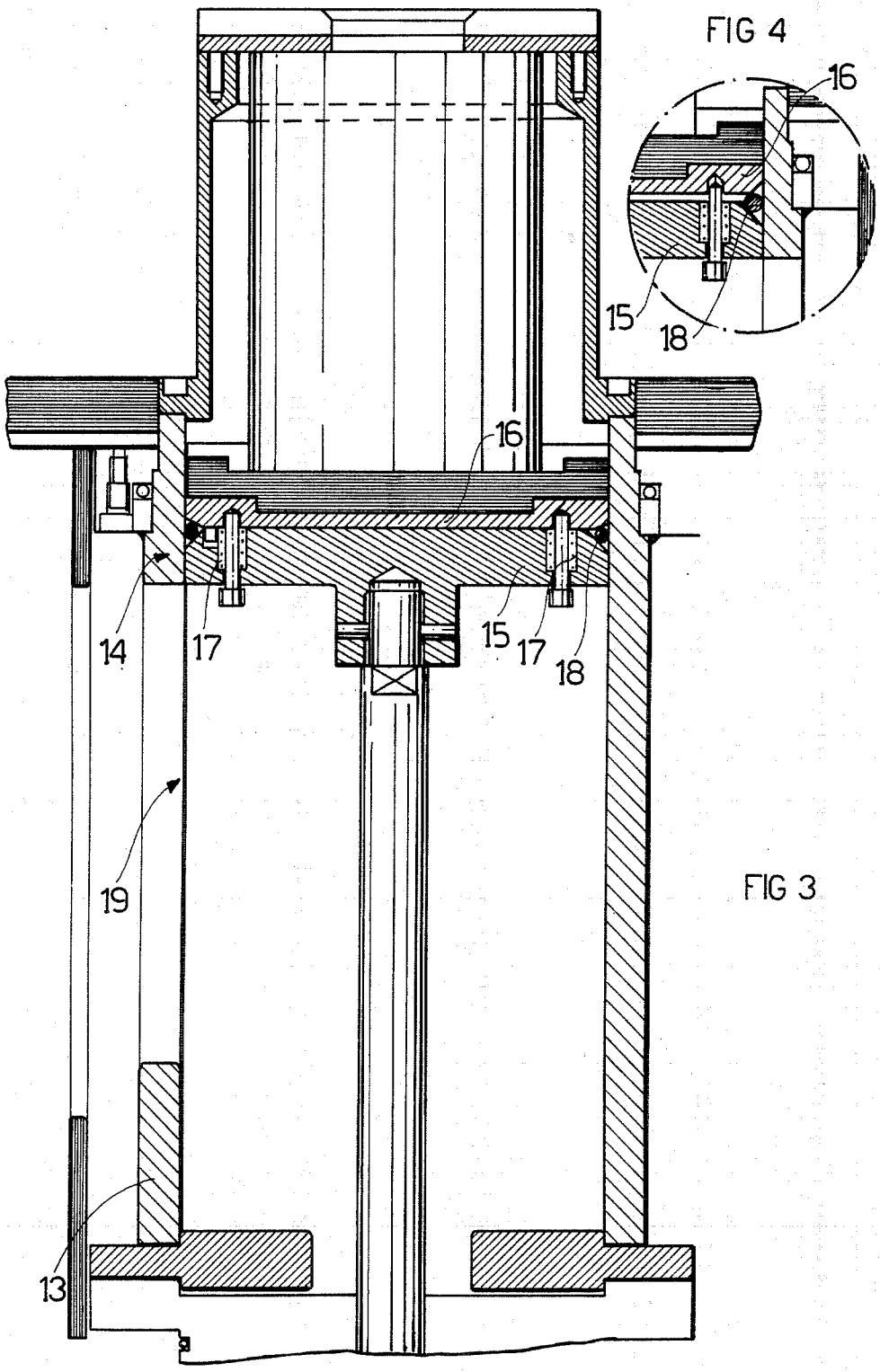
FIG. 3 shows the partial section of an apparatus according to the invention.

In the wall of bed 2 and in the wall of cylinder 13 there is an opening 19 through which it is possible to have access inside the cylinder to place a basket 20 on the plane formed by piston 14, when the latter is in its fully lowered position. Such an arrangement, shown in FIG. 2, allows to easily feed the apparatus without having to open the same, by just lowering piston 14 and inserting the basket inside the cylinder.

The inside of chamber 1 is connected with a pump 26 capable of producing internally a certain degree of vacuum, while the inside of chamber 4 is linked, through a valve 21 of known type, to a tank 22 wherein is produced a boosted vacuum by means of a high vacuum pump 23.

Obviously, instead of the pumps 26 and 23 shown in the drawing, only one high vacuum pump may be used, that will be connected each time by suitable switches either with tank 22 or with the inside of chamber 1.

The bell 3 rests on a gasket 24 situated connected with the boundary zone of the upper wall of bed 2, and may be let up and down by known means.

It is made of a material apt to bear a high vacuum and is provided with one or more bull's eyes 25, preferably of tempered glass, allowing to visually check the operations that are carried out inside.

The working takes place as follows:

the furnace 7 is fed with the necessary amount of metal, and the piston 14 is brought to its lowered position. In this stage the two parts 15 and 16 of which the piston is made are slightly detached, by effect of the thrust exerted by springs 17, as shown in FIG. 4.

At this point it is possible to position in cylinder 13, through the opening 19, the basket 20 carrying the plaster mold, that is allowed to rest on the plane formed by the piston.

The latter is then let up until the upper edge of the basket—coated with a suitable gasket—is brought in contact with the upper wall 35 of chamber 4. The pressure that drives the piston up also makes the parts 15 and 16 of the piston get closer to each other, in contrast with the pull exerted by springs 17. As a consequence thereof, the annular gasket 18 is thrusted outwards and pressed against the walls of cylinder 15, so as to ensure tightness.

Then the vacuum pumps 23 and 26 (with bell 3 properly positioned on bed 2 and on gasket 24) are actuated and the furnace device 7 is turned on.

During this step a certain degree of vacuum is produced inside bell 3 by the pump 26, while at the same time the pump 23 produces a higher vacuum in tank 22 (in this position the valve 21 links the pump 23 to the tank).

Due to the existing vacuum in chamber 1, it is possible to suck the air pockets—if any—present in the melted metal.

When the furnace has reached the pre-set melting temperature, automatic means lift the cover and actuate the motor 12 (provided with a suitable reducer), which makes the furnace incline to pour the melted metal in the mold.

The electrovalve 21 opens the connection between the inside of chamber 4 and tank 22, so that the higher vacuum brings about a sucking action particularly effective in absorbing the fumes and gases that form at the moment when the molten metal touches the walls of the plaster mold.

Thus is it possible to obtain melted pieces with smooth surface, perfectly malleable and without any impurity or fault.

The means for the automatic operation of the apparatus could either be absent, or be left unactuated when it is desired to effect manually the different operations; this is the case, for instance, when the metal is melted in an outer furnace of known kind, in such an amount as to supply several apparatuses.

From said furnace the already molten metal is tapped into the furnace 7, that has the function of keeping it liquid while vacuum is produced inside the bell 3, to subject it to de-gassing.

At the end of the cycle, after connecting chambers 1 and 3 with the environment, the piston 14 is lowered to take out the basket that contains the cast.

Of course the sizes, as well the used materials, may vary according to the requirements of use.

I claim:

1. Apparatus for casting comprising:

a bell;

a furnace contained in the bell for metal melting;

a mold having gas-permeable walls;

a vessel within the bell for receiving said mold for casting molten metal;

means for inserting said mold into said vessel without lifting said bell;

means for inclining said furnace for flowing molten metal into said mold received in said vessel;

means for producing a first level of vacuum inside said bell for removing gas pockets from molten metal;

means for producing a second level of vacuum, higher than said first level, inside said vessel substantially contemporaneous with inclining of said furnace for evacuating through said gas-permeable walls of the mold gases that form when molten metal touches said walls of said mold.

2. An apparatus according to claim 1, wherein the vessel comprises a chamber whose lower wall is formed by a piston that can move up and down inside a cylinder from a first lower position in which a basket containing the mold may be inserted, and a second upper position in which said basket is brought inside said vessel.

3. An apparatus according to claim 2, wherein said piston comprises two superimposed parts which are maintained slightly spaced apart by elastic means, one of said parts moving in closer proximity to a second of said parts in conjunction with an upward stroke of the piston causing an annular gasket to be compressed against walls of the cylinder within which said piston glides.

4. An apparatus according to claim 1, further comprising means suitable for adjusting position of the furnace so as to accurately pour molten metal when said furnace is overturned.

5. Apparatus of claim 1 wherein said means for producing a second level of vacuum comprises a vacuum pump coupled to a tank by a valve, said valve coupling said tank to said vessel to produce said second level of vacuum.

* * * * *